United States Patent [19]

Burns

[11] 4,378,231

[45] Mar. 29, 1983

[54] MOTOR FUEL

[75] Inventor: Lyle D. Burns, Bartlesville, Okla.

[73] Assignee: Phillips Petroleum Company, Bartlesville, Okla.

[21] Appl. No.: 200,291

[22] Filed: Oct. 24, 1980

[51] Int. Cl.[3] ..... C10L 1/22

[52] U.S. Cl. ..... 44/75; 44/79; 564/390

[58] Field of Search ..... 44/75, 79; 564/390

[56] References Cited

U.S. PATENT DOCUMENTS 2,553,441 5/1951 Chenicek ..... 44/75

OTHER PUBLICATIONS

Chemical Abstracts, vol. 88, Chemical Substance Index, I-PO, Jan.-Jun., 1978, pp. 3620cs, 132-88:91891x.

*Primary Examiner*—Charles F. Warren
*Assistant Examiner*—Y. Harris-Smith

[57] ABSTRACT

Liquid hydrocarbon fuel compositions are provided containing antiknock quantities of ashless antiknock additives selected from 2-(dimethylaminomethyl) phenols substituted in the 4-position with fluoride and methoxy groups. Novel compositions of matter are provided comprising substituted dimethylaminomethyl phenols.

11 Claims, No Drawings

MOTOR FUEL

This invention relates to liquid hydrocarbon fuel compositions having improved antiknock properties. In one of its aspects, this invention relates more particularly to liquid hydrocarbon fuel compositions intended for use in internal combustion engines containing novel and effective ashless antiknock agents. In accordance with a further aspect, this invention relates to liquid hydrocarbon compositions containing antiknock quantities of ashless antiknock agents comprising selected substituted dimethylaminomethyl phenols.

Various antiknock agents have, heretofore, been suggested and employed for use in liquid hydrocarbon fuels, particularly in fuels employed in internal combustion engines. In such engines, it is highly desirable, from a stand point of economics that combustion of the fuel occurs at relatively high compression ratios. Such high compression ratios concomitantly necessitate the use of fuels having relatively high octane numbers to insure knock-free operation. Many antiknock agents have been proposed and/or used to improve the antiknock properties of hydrocarbon fuels used for internal combustion engines. In general, however, none of these antiknock additives have proved to be satisfactory in effectively raising the octane number of the fuel without also exhibiting other undesirable properties of varying importance. The phase-down of lead in gasoline as required by federal law and the banning of certain additives from use in unleaded gasoline has given impetus to continuation of a systematic study of the antiknock activity of ashless (non-metallic) compounds. The present invention is directed to the use of ashless (non-metallic) additives as antiknock agents for internal combustion fuels.

Accordingly, an object of this invention is to provide ashless hydrocarbon fuel compositions.

Another object of this invention is to provide ashless (non-metallic) antiknock additives for internal combustion engine fuels.

Another object of this invention is to provide hydrocarbon fuel compositions exhibiting improved antiknock properties.

Other objects, aspects as well as the several advantages of the invention will be apparent to those skilled in the art upon reading the specification and the appended claims.

In accordance with the present invention, new and improved liquid hydrocarbon fuel compositions are provided containing an antiknock quantity of ashless (non-metallic) additives selected from substituted dimethylaminomethyl phenols.

More specifically, 2-(dimethylaminomethyl)phenols that are substituted in the 4-position with fluoride or methoxy groups are effective when dissolved in gasoline to increase its octane number as measured by the Motor Method.

Further, according to the invention, novel compositions of matter are provided comprising 2-dimethylaminomethyl-4-methoxyphenol and 2-dimethylaminomethyl-4-fluorophenol.

Specific examples of ashless antiknock agents of the invention that can be used in internal combustion engine fuels are 2-dimethylaminomethyl-4-methoxyphenol and 2-dimethylaminomethyl-4-fluorophenol, and mixtures thereof. These compounds have suitable solubility and volatility characteristics to permit their application as additives for hydrocarbon fuels.

The antiknock additives of the invention are highly suited for use in fuels in view of their ashless characteristics. Naturally, the various compounds of the herein disclosed group do not possess exactly identical effectiveness, and the most advantageous concentration for each such compound will depend to some extent upon the particular compound used. Also, the minimum effective inhibitor concentration can vary somewhat according to the specific nature of the hydrocarbon composition to which it is added.

The amounts of the antiknock agents of the invention added to the hydrocarbon fuels will be sufficient to improve the antiknock properties of the fuel. In general, these novel antiknock additives are employed in amounts from about 0.5 to about 10 percent (5000 to 100,000 parts per million), preferably from about 1 to about 5 percent (10,000 to 50,000 parts per million), by weight of the total weight of the fuel composition.

The motor fuels or gasolines into which the invention additives are incorporated are conventional motor fuel distillates boiling in the range of 70°-420° F. (21.1°-216° C.). Gasolines or automotive fuels to which the described additives perform the functions described herein include substantially all grades of gasoline presently being employed in automotive and internal combustion aircraft engines. Generally automotive and aircraft gasolines contain both straight run and cracked stock with or without alkylated hydrocarbons, reformed hydrocarbons and the like. Such gasolines can be prepared from saturated hydrocarbons, e.g., straight run stocks, alkylation products and the like with or without gum inhibitors, detergents, corrosion inhibitors, solvents, emulsifiers, and the like. The motor fuels are unleaded and can contain other conventional fuel additives such as antioxidants and the like. The characteristics and properties of the unleaded gasoline employed herein are listed as follows:

CHARACTERISTICS OF TEST GASOLINE

Description: Unleaded Kansas City Premium Pipeline Base Gasoline

| | |
|---|---|
| Designation | FT-175 |
| Reid Vapor Pressure, psi | 7.2 |
| API Gravity @ 60F. | 64.4 |
| ASTM Distillation | |
| Vol % Evaporated | Temp., F. |
| IBP | 86 |
| 5 | 115 |
| 10 | 132 |
| 15 | 145 |
| 20 | 157 |
| 30 | 178 |
| 40 | 197 |
| 50 | 213 |
| 60 | 229 |
| 70 | 250 |
| 80 | 286 |
| 90 | 353 |
| 95 | 391 |
| EP | 428 |
| Lead Content, g/gal | 0.005 |
| Sulfur Content, wt % | 0.04 |
| Research Octane Number | 91.5 |
| Motor Octane Number | 83.9 |
| Component | vol % |
| Paraffins | 69.03 |
| Olefins | 15.01 |
| Napthenes | 6.63 |
| Aromatics | 9.33 |
| Average Molecular Weight | 101.3 |
| Atomic Ratio: Hydrogen/Carbon | 2.10 |

-continued

| CHARACTERISTICS OF TEST GASOLINE | |
|---|---|
| Description: Unleaded Kansas City Premium Pipeline Base Gasoline | |
| Stoichiometric Air-Fuel Ratio | 14.89 |

SPECIFIC EXAMPLE

The phenols 2-dimethylaminomethyl-4-methoxyphenol (I) and 2-dimethylaminomethyl-4-fluorophenol (II) were prepared in the following manner.

Synthesis of Compound I: To a flask fitted with an addition funnel, a stirrer, and a thermocouple was added 62 g (0.5 mole) of p-methoxyphenol. After cooling the flask in ice water 62 ml (0.55 moles) of 40% aqueous dimethylamine was added dropwise, the temperature being maintained below 25° C. While still being cooled 16.5 g (0.55 moles) of formaldehyde in aqueous solution was added dropwise. After about 30 minutes, with stirring, the flask was heated to about 75° C. for nearly 3 hours and treated with enough sodium chloride to saturate the solution. After an hour the less dense organic layer was separated and subjected to distillation at reduced pressure. A fraction that weighed 59.5 g, representing 65% of the theoretical yield, was separated at 133° C. and 1.25 mm Hg pressure. It was subjected to elemental analysis to confirm the identity of 2-dimethylaminomethyl-4-methoxyphenol, $C_{10}H_{15}NO_2$.

| Element | Calculated | Found |
|---|---|---|
| C | 66.27 | 66.43 |
| H | 8.34 | 8.26 |
| N | 7.73 | 7.53 |

The results support the suggested composition of the new compound. Results of NMR and infrared analyses were also consistent with the proposed structure.

Synthesis of Compound II: With the replacement of 56 g (0.5 moles) of p-fluorophenol for p-methoxyphenol this compound was synthesized exactly as described for compound I, above. The product, isolated as above, was subjected to distillation at reduced pressure. A fraction that weighed 46.2 g, representing 55% of the theoretical yield, was separated at 75° C. and 0.4 mm Hg pressure. It was subjected to elemental analysis to confirm the identity of 2-dimethylaminomethyl-4-fluorophenol, $C_9H_{12}FNO$.

| Element | Calculated | Found |
|---|---|---|
| C | 63.89 | 63.83 |
| H | 7.15 | 7.04 |
| N | 8.28 | 8.14 |

The results support the suggested composition of the new compound. Results of NMR and infrared analyses were also consistent with the proposed structure.

The phenols 2-dimethylaminomethyl-4-methoxyphenol (I) and 2-dimethylaminomethyl-4-fluorophenol (II) were dissolved singly at a concentration of 0.1 molar in clear (unleaded) FT-175 gasoline. Each gasoline was engine tested to determine its Research Octane Number (RON) according to ASTM D 2699-47. In addition, chemically similar compounds were tested in gasoline, at the same molarity, to demonstrate the unexpected differences in RON that are observed. These compounds (which are not considered to be part of this invention) are p-hydroxyanisole (III), anisole (IV), phenol (V), N,N-dimethylbenzylamine (VI), and p-fluorophenol (VII). The following table presents the increase in RON over the untreated fuel produced by the addition of these compounds.

| Compounds | Conc., wt. % | RON increase |
|---|---|---|
| I (Invention) | 2.4 | 2.6 |
| II (Invention) | 2.3 | 2.7 |
| III | | 0.4 |
| IV | | 0.3 |
| V | | 0.7 |
| VI | | −0.6 |
| VII | | 0.9 |

The efficacy of the novel ashless antiknock compounds of the present invention for improving the antiknock properties of liquid hydrocarbon fuels will be apparent from the foregoing example and comparative data. It will be understood that the novel ashless antiknock compounds of the present invention can be advantageously employed in any liquid hydrocarbon fuel composition which is suitable for use in a combustion engine regardless of the purpose for which the engine is designed.

I claim:

1. An internal combustion fuel composition comprising a major proportion of a motor fuel containing a small but effective amount, sufficient to impart reduced knocking tendencies to said motor fuel, of an ashless antiknock additive which is 2-dimethylaminomethyl-4-fluorophenol.

2. A composition according to claim 1 wherein the motor fuel contains from about 0.1 to about 10 weight percent of said additive.

3. A composition according to claim 1 wherein the motor fuel is a distillate boiling in the range of about 70° F. to about 420° F. (21.1°–216° C.).

4. A gasoline composition containing an antiknock quantity of 2-dimethylaminomethyl-4-fluorophenol.

5. The composition of claim 4 containing from about 0.1 to about 10 percent by weight of 2-dimethylaminomethyl-4-fluorophenol.

6. The composition of claim 4 containing from about 1 to about 5 percent by weight of 2-dimethylaminomethyl-4-fluorophenol.

7. The compound 2-dimethylaminomethyl-4-fluorophenol (II).

8. A method for improving the antiknock properties of a motor fuel which comprises incorporating therein a small but effective amount sufficient to impart reduced knocking tendendies to said motor fuel of an ashless antiknock additive which is 2-dimethylaminomethyl-4-fluorophenol (II).

9. A method according to claim 8 wherein the motor fuel is unleaded and contains from about 0.1 to about 10 weight percent of said additive.

10. A method according to claim 8 wherein said motor fuel is unleaded gasoline.

11. A method according to claim 10 wherein said gasoline contains from about 1 to about 5 weight percent of said additive.

* * * * *